US009708910B2

(12) United States Patent
Jorda

(10) Patent No.: US 9,708,910 B2
(45) Date of Patent: Jul. 18, 2017

(54) INWARDLY OPPOSED PISTONS, FIXED POSITION COMMON CYLINDER ENGINE WITH EXTERNAL INDUCTION

(75) Inventor: Scott Gali Jorda, Westminster, MD (US)

(73) Assignee: Warren Engine Company, Inc., Bluemont, VA (US)

( * ) Notice: Subject to any disclaimer, the term of this patent is extended or adjusted under 35 U.S.C. 154(b) by 215 days.

(21) Appl. No.: 13/228,442

(22) Filed: Sep. 8, 2011

(65) Prior Publication Data

US 2012/0055451 A1 Mar. 8, 2012

Related U.S. Application Data

(60) Provisional application No. 61/380,946, filed on Sep. 8, 2010.

(51) Int. Cl.
*F01B 7/02* (2006.01)
*F02B 75/28* (2006.01)
*F01B 7/14* (2006.01)

(52) U.S. Cl.
CPC ..... *F01B 7/14* (2013.01); *F02B 75/282* (2013.01)

(58) Field of Classification Search
CPC .. F01B 7/02; F02B 75/28; F16H 23/08; F16H 19/043
USPC ..... 123/51 R, 53.6, 55.2, 55.4, 55.5, 58.1, 123/197.1–197.3
See application file for complete search history.

(56) References Cited

U.S. PATENT DOCUMENTS

| | | | | | |
|---|---|---|---|---|---|
| 2,303,025 | A * | 11/1942 | Cliff | F02B 75/26 | 123/41.81 |
| 2,345,056 | A * | 3/1944 | Mallory | F01B 7/14 | 123/51 BA |
| 2,422,238 | A * | 6/1947 | Harmon | 123/55.4 | |
| 3,398,728 | A * | 8/1968 | Hardman | 123/55.7 | |
| 4,244,338 | A * | 1/1981 | Rassey | 123/190.2 | |
| 4,312,306 | A * | 1/1982 | Bundrick, Jr. | F01B 7/04 | 123/51 BA |
| 4,753,198 | A * | 6/1988 | Heath | F01L 13/0042 | 123/188.9 |
| 5,058,536 | A * | 10/1991 | Johnston | F01B 7/14 | 123/51 BA |
| 5,083,530 | A * | 1/1992 | Rassey | 123/51 R | |
| 5,623,894 | A * | 4/1997 | Clarke | 123/50 R | |
| 7,434,549 | B2 * | 10/2008 | Tse | 123/51 R | |
| 2010/0170466 | A1 * | 7/2010 | Warren et al. | 123/190.1 | |

* cited by examiner

*Primary Examiner* — Marguerite McMahon
*Assistant Examiner* — Tea Holbrook
(74) *Attorney, Agent, or Firm* — L.C. Begin & Associates, PLLC.

(57) ABSTRACT

An engine with a design for an inwardly opposed-piston, 4 cycle engine with a common, fixed cylinder and external induction system. The present invention features include a fixed, common cylinder in which 2 pistons move towards each other during the cycling of the engine, external, modular, fix mounted induction and exhaust system, multiple power take off shafts as well as additional cylinder/piston bank modularity. The production of such design provides for increased thermal, mechanical and volumetric efficiency as it relates to similar internal combustion engines.

17 Claims, 3 Drawing Sheets

INWARDLY OPPOSED PISTONS, FIXED POSITION COMMON CYLINDER ENGINE WITH EXTERNAL INDUCTION

The current application claims a priority to the U.S. Provisional Patent application Ser. No. 61/380,946 filed on Sep. 8, 2010.

FIELD OF THE INVENTION

The present invention relates generally to an engine. More specifically, the present invention is a four cycle engine with opposing pistons utilizing a fixed position common cylinder and external induction.

DETAIL DESCRIPTIONS OF THE INVENTION

Figure 1:
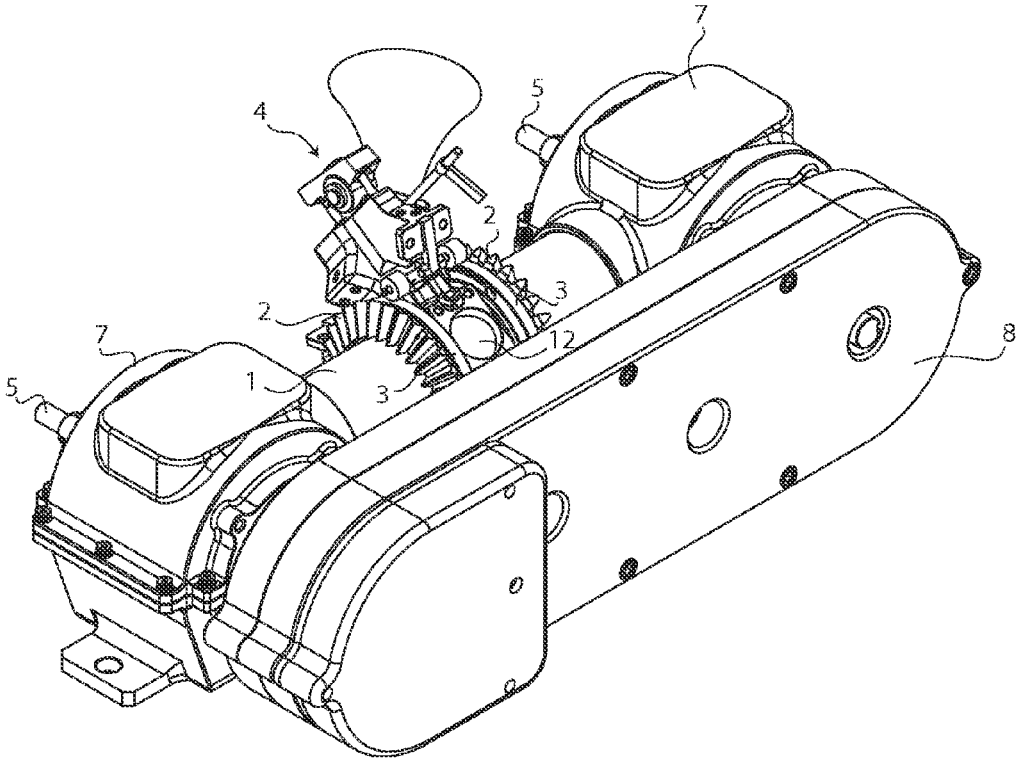
FIG. 1 is a perspective view of the present invention.

All illustrations of the drawings are for the purpose of describing selected versions of the present invention and are not intended to limit the scope of the present invention.

In reference to FIG. 1-4, the present invention is an engine utilizing inwardly opposed pistons that share a fixed cylinder combustion chamber 11. The present invention additionally utilizes external induction to provide the proper fuel to air ratio within the combustion chamber 11. The present invention comprises a shared cylinder 1, a pair of cylinder bevel gears, a pair of cam wheels 3, at least one valve module 4, a pair of crankshaft 5, a pair of pistons 6, a pair of crank chambers 7, a quad gear chamber 8, a quad gear assembly 9, a pair of timing bevel gears 10, and a pair of timing gears. The shared cylinder 1 is in a fixed position and does not rotate. The following description provided describes an embodiment of the present invention with two pistons and a single shared cylinder 1. However, the intention of the present invention is to provide a modular design where there may be additional shared cylinder 1 and pistons. In other embodiments of the present invention, there may be four or six pistons with two or three shared cylinders 1, respectively.

Figure 2:
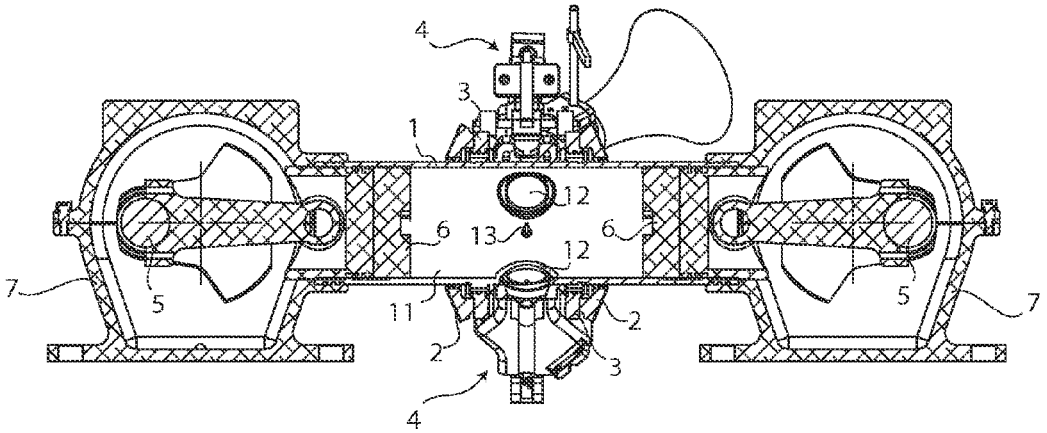
FIG. 2 is a cross sectional view of the crank chamber and the shared cylinder to show the assembly of the piston.
Figure 3:
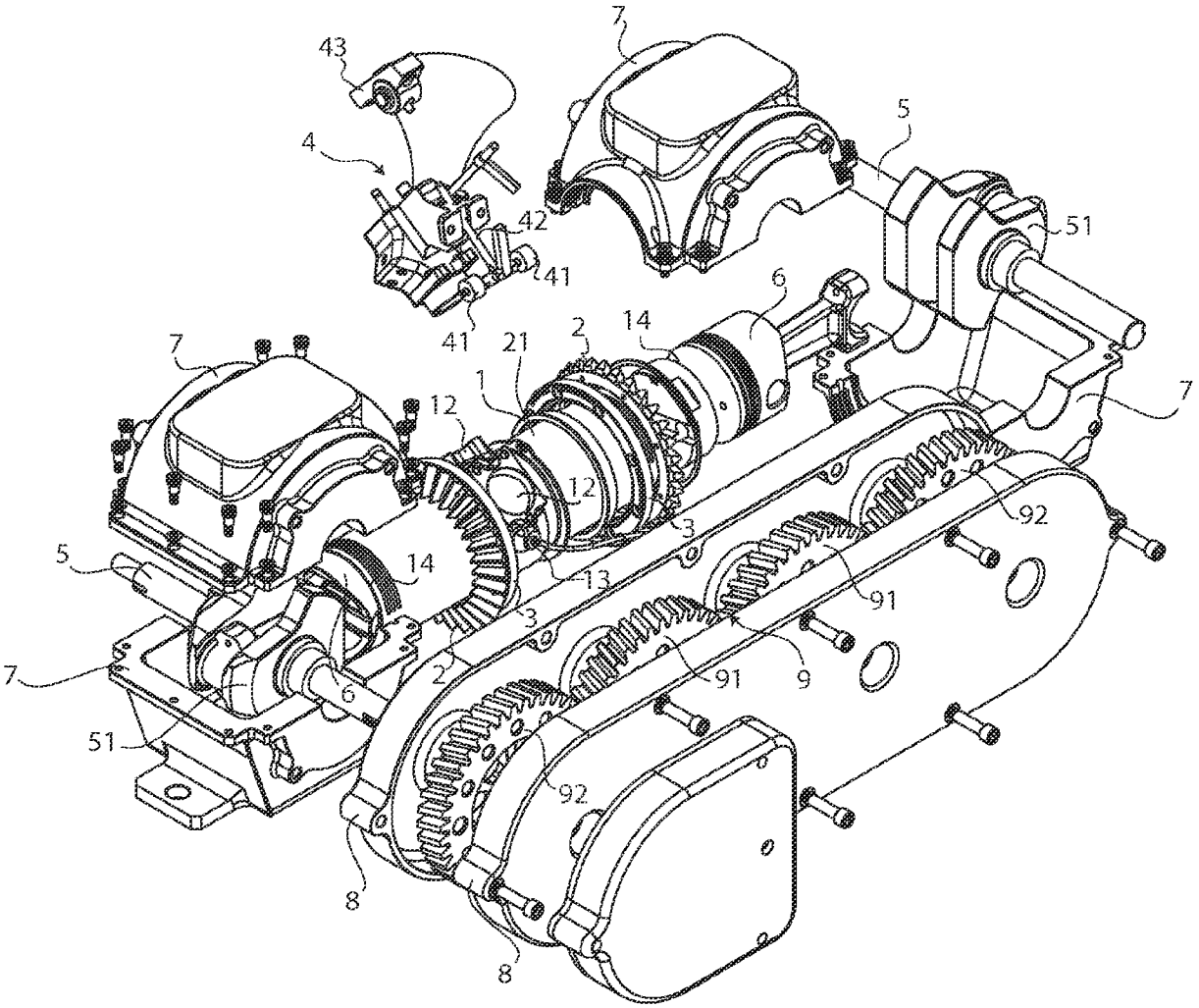
FIG. 3 is an exploded view of the present invention.

In reference to FIG. 2-3, the shared cylinder 1 provides space for two pistons to be powered by a single combustion chamber 11. More specifically, the shared cylinder 1 further comprises of a combustion chamber 11, at least one valve module opening 12, at least one ignition point 13, and a pair of opposing piston openings 14. The combustion chamber 11 is a cylindrical space that traverses through the shared cylinder 1. The at least one valve module openings 12 are holes that are traversed through the shared cylinder 1 into the combustion chamber 11. In embodiments of the present invention where there are more than one valve modules 4, the valve module openings 12 are circumferentially positioned about the shared cylinder 1. This center positioning of the valve module openings 12 allow the engine to provide intake and exhaust directly in between the two opposing pistons within the combustion chamber 11. In a similar fashion, the at least one ignition point 13 is circumferentially positioned about the shared cylinder 1 adjacent to the at least one valve module openings 12. In some embodiments of the present invention, there may be more than one ignition point 13 where spark plugs, spark rod, or any other igniting means may be inserted to provide optimal burning within the combustion chamber 11. However, provided there is more than one ignition point 13, it is important for the plurality of ignition points 13 to be evenly distributed about the circumference of the shared cylinder 1. The even distribution of the ignition points 13 will provide a more evenly distributed and optimal combustion. In other embodiments of the invention, the ignition points 13 may be irregularly distributed. The pair of piston openings 14 is holes that are positioned on a first end and a second end of the shared cylinder 1 leading into the combustion chamber 11. These openings allow the pair of pistons 6 to be inserted into the combustion chamber 11 and be extended further in by the connecting rods when being moved by the crankshaft 5.

The pair of cylinder bevel gears 2 is concentrically attached to the shared cylinder 1 by means of a pair of bearings 21. With the shared cylinder 1 being fixed, the pair of bearings 21 allows the pair of cylinder bevel gears 2 and the pair of cam wheels 3 to pivot about the shared cylinder 1. Each of the cylinder bevel gears 2 are directly positioned adjacent to the valve module openings 12. It is important for the cylinder bevel gears 2 to be facing opposite directions to provide consistent directions of rotation. The pair of cam wheels 3 is wheels that are directly fastened to the flat side of the pair of cylinder bevel gears 2. The pair of cam wheels 3 are used to control the intake and exhaust of the at least one valve modules 4. The at least one valve module 4 are fastened to the at least one valve opening. Each of the valve modules 4 further comprises a pair of timing wheels 41, a push rod 42, and a rocker 43. Within each valve module 4 is a poppet valve, butterfly valve, or any other type of valve system for controlling the intake of air/fuel and exhaust. However, the present invention provides the engine with control of the timing for intake and exhaust by means of the pair of timing wheels 41. The pair of timing wheels 41 is engaged to the pair of cam wheels 3. The turning of the pair of cam wheels 3, in turn, rotates the pair of timing wheels 41. The push rod 42 is a rod that connects the timing wheels 41 to the rocker 43. The push rod 42 is attached to the pair of timing wheels 41 and engaged to the rocker 43 at the opposite end. While the timing wheels 41 are being rotated, the push rod 42 is configured to push and release the rocker 43 to open and close the poppet valve within the valve module 4.

Figure 4:
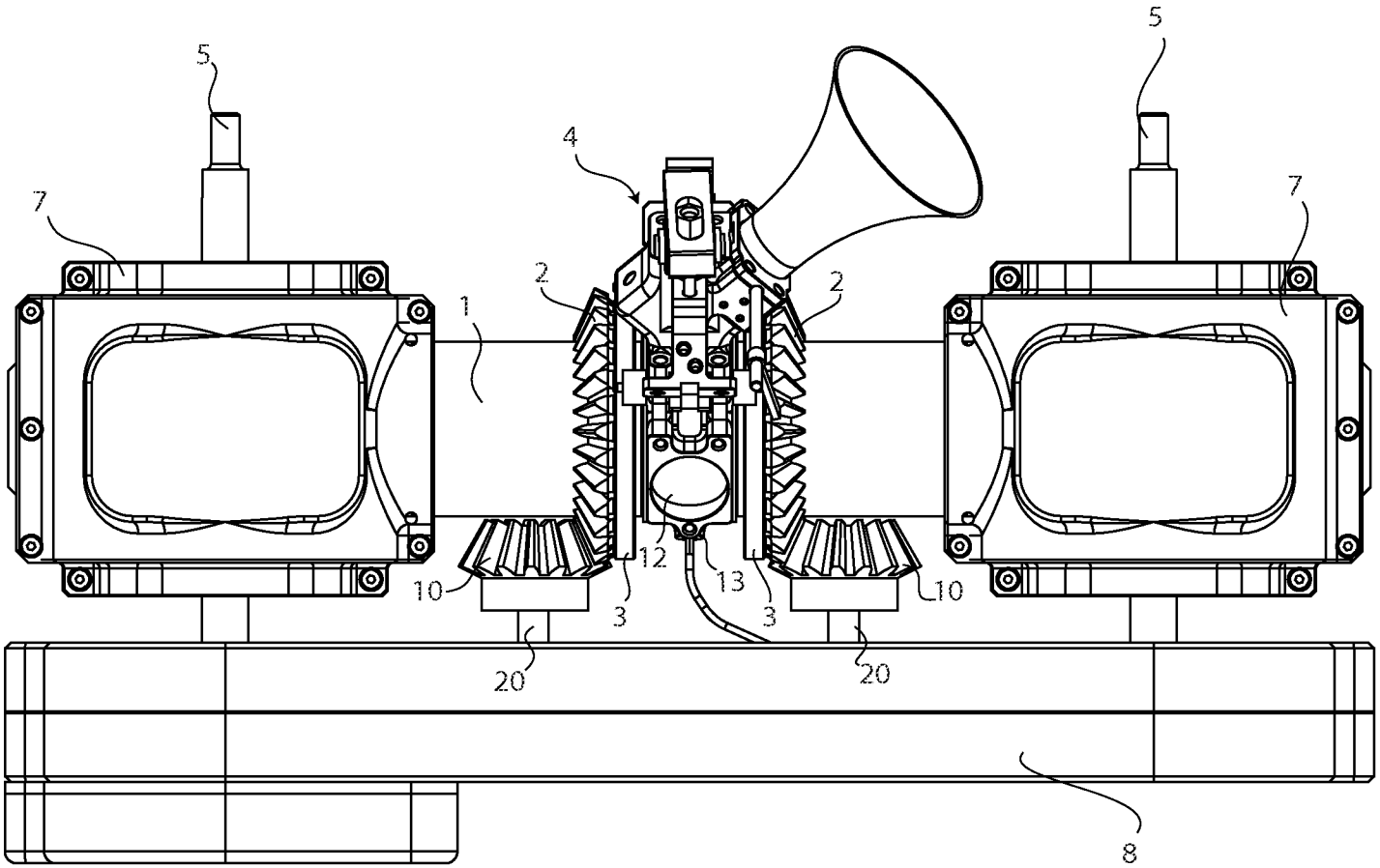
FIG. 4 is a top plan view of the present invention.

In reference to FIG. 2-4, the pair of crank chambers 7 is enclosures that protect the rotating crankshafts 5. The pair of crank chambers 7 is fastened to the shared cylinder 1. Having two opposing pistons and two crankshafts 5, two crank chambers 7 are required. A first crank chamber 7 is fastened to the first cylinder end of the shared cylinder 1 and a second crank chamber 7 is fastened to the second cylinder end of the shared cylinder 1. Each crankshaft 5 further comprises of a crank, wherein a first crankshaft 5 comprises a first crank 51 and a second crankshaft 5 comprises a second crank. The first crank 51 is positioned in the first crank chambers 7 and the second crank 51 is positioned in the second crank chambers 7. The pair of pistons 6 is jointly secured to the corresponding crank 51 by means of the connecting rod wherein a first piston 6 is jointly secured to the first crank 51 and a second piston 6 is jointly secured to the second crank. The first piston 6 and the second piston 6 are positioned inside the combustion chamber 11 in opposing relationship to each other. As a result, to ensure synchronized timing between the two opposing pistons, the cranks of the pair of crankshafts 5 must be positioned in equal but opposite positions.

The timing of the at least one valve modules 4 are controlled by means of the quad gear assembly 9. The quad gear assembly 9 further comprises a pair of valve gears 91 and a pair of crankshaft gears 92. The gears of the quad gear assembly 9 may by any circular gear including spur gears, helical gears, double helical gears, or any other suitable circular gears. However, in the preferred embodiment of the present invention, the quad gear assembly 9 utilizes helical gears to preserve smooth and quiet transfer of rotational energy. The pair of valve gears 91 is engaged to each other. The pair of crankshaft gears 92 is engaged to the pair of valve gears 91, wherein a first valve gear is engaged to a second valve gear, a first crankshaft gear is engaged to the first valve gear, and a second crankshaft gear is engaged to the second valve gear. For protective and mounting purposes, the quad gear assembly 9 is encased by the quad gear chamber 8. With the pair of crank chambers 7 and the shared cylinder 1 positioned adjacent to the quad gear chamber 8, the first crankshaft 5 is extended from the first crank chambers 7 and is inserted into the quad gear chamber 8 to be concentrically engaged to the first crankshaft gear. The second crankshaft 5 is extended from the second crank chambers 7 and is inserted into the quad gear chamber 8 to be concentrically engaged to the second crankshaft gear. The pair of timing shafts 20 is concentrically engaged and extended from the pair of valve gears 91 towards the pair of cylinder bevel gears 2 on the shared cylinder 1. The pair of timing bevel gears 10 is concentrically connected to the pair of timing shafts 20 and is engaged to the pair of cylinder bevel gears 2.

As the four stroke cycle of the engine proceeds, the two pistons will move in towards and out from the center of the combustion to rotate the cranks and the pair of crankshafts 5. The rotational energy is transferred directly the quad gear assembly 9. The pair of crankshaft gears 92, in turn, rotates the pair of valve gears 91. With the pair of timing shafts 20 being connected to the pair of valve gears 91, the rotational energy is transferred to the pair of timing bevel gears 10. The pair of timing bevel gears 10 rotates the pair of cylinder bevel gears 2. Being attached to the pair of cylinder bevel gears 2, the cam wheels 3 transfer the rotational energy to the pair of timing wheels 41 on the at least one valve modules 4. The timing wheels 41 are then used to control the cycle within the combustion chamber 11 for intake of a properly ratio fuel/air mixture, compression, combustion, and exhaust. The mechanical timing between the pair of crankshafts 5 is based upon the quad gear assembly 9 to ensure that the timed valve operations for the induction/exhaust process is matched to the rotation of the crankshaft 5. The present invention may incorporate a forced induction system via either a centrifugal or exhaust heat turbo charger setup, or any other methods of air intake. Additionally, the present invention may also be a carbureted or fuel injected inducted engine, or any other fuel delivery induction system.

The present invention provides a modular design that provides the user of the present invention to add additional cylinders and corresponding piston pairs. Through the extension of the crankshaft 5, additional crank chambers 7 may be added and secured by means of a chamber mount. Modular additions of multiple pistons and cylinders on common external power take off shafts allow for variation of engine power production based upon situational requirements. The two opposing sides of the crank chambers 7 where the crankshaft 5 is extended from is shaped to allow the crank chambers 7 to be fastened to additional crank chambers or the quad gear chamber 8. The ability for expansion and addition of pistons/cylinder modules may be added to the pair of crankshafts 5 utilizing varied compression rations allowing for use of multiple fuel platforms to include diesel, gasoline, JP8, oil, enriched oxygen and hydrogen, bio-fuels, or any other suitable fuel/energy sources. The present invention may also have multiple electrical charging mechanisms for the purpose of charging electrical storage for the incorporation of hybrid electric-gasoline arrangements.

In other embodiments of the invention, there can be at least one cylinder bevel gear 2 or more, at least one cam wheel 3 or more, at least one timing wheel 41 or more, at least one timing bevel gear 10 or more, and at least one timing shaft 20 or more. Additionally, in other embodiments, there can be a multi gear assembly 9 and a multi gear chamber 8.

Although the invention has been explained in relation to its preferred embodiment, it is to be understood that many other possible modifications and variations can be made without departing from the spirit and scope of the invention as hereinafter claimed.

What is claimed is:

1. An inwardly opposed piston, fixed position common cylinder engine with external induction comprising:

a shared cylinder containing a periphery, a first end, a second end, and a median portion, the shared cylinder comprising a combustion chamber, at least one valve module opening, at least one ignition point, and a pair of opposing piston openings;

a first cylinder bevel gear and a second cylinder bevel gear each rotatably fixed about the periphery and the median portion;

a first cam wheel fixed to said first cylinder bevel gear, and, a second cam wheel fixed to said second cylinder bevel gear, said first and second cam wheels rotatable about said shared cylinder;

at least one valve module operably communicating with said first and second cam wheels and said cylinder, the at least one valve module comprising a first timing wheel and a second timing wheel rotatably communicating with said first and second cam wheels, respectively, a rocker, and a push rod operably connecting said first and second timing wheels with said rocker;

a quad gear chamber for containing a quad gear assembly, the quad gear assembly comprising a first valve gear and a second valve gear, and, a first crankshaft gear and a second crankshaft gear, each of said gears interlocking with at least one other of said gears;

a first crankshaft contained within a first crank chamber and rotatably communicating with said first crank gear, and, a second crankshaft contained within a second crank chamber and rotatably communicating with said second crank gear;

a first piston operably communicating with said first crankshaft, and a second piston operably communicating with said second crankshaft, each piston contained within said shared cylinder;

a first timing bevel gear rotatably communicating with said first valve gear, and, a second timing bevel gear rotatably communicating with said second valve gear, said first and second timing bevel gears also rotatably communicating with said first and second cylinder bevel gears, respectively; and a first timing shaft connecting said first valve gear with said first timing bevel gear, and, a second timing shaft connecting said second valve gear with said second timing bevel gear.

2. The inwardly opposed piston, fixed position common cylinder engine with external induction as claimed in claim 1 wherein:

the combustion chamber is a cylindrical space traversing through the shared cylinder;

the at least one valve module opening comprises holes traversing through the shared cylinder into the combustion chamber and being circumferentially positioned about the shared cylinder;

the at least one ignition point is circumferentially positioned about the shared cylinder adjacent to the at least one valve module opening; and a first and a second piston opening of the pair of piston openings are positioned on a first end and a second end, respectively, of the shared cylinder leading into the combustion chamber.

3. The inwardly opposed piston, fixed position common cylinder engine with external induction as claimed in claim 1 wherein:

the first and second cylinder bevel gears are concentrically attached to the shared cylinder by means of a pair of bearings, wherein the each cylinder bevel gear is directly positioned adjacent to the at least one valve module opening;

each of the first and second cam wheels is concentrically fastened to the first and second cylinder bevel gears, respectively.

4. The inwardly opposed piston, fixed position common cylinder engine with external induction as claimed in claim 1 wherein:

the at least one valve module is fastened to the at least one valve module opening.

5. The inwardly opposed piston, fixed position common cylinder engine with external induction as claimed in claim 1 wherein:

each of the first and second crank chambers is fastened to the shared cylinder, wherein said first crank chamber is fastened to a first cylinder end of the shared cylinder and said second crank chamber is fastened to a second cylinder end of the shared cylinder;

each crankshaft comprising a crank, wherein a first crankshaft comprises a first crank and a second crankshaft comprises a second crank;

the first crank is positioned in the first crank chamber;

the second crank is positioned in the second crank chamber;

the first and second pistons being jointly secured to the first and second cranks, respectively;

the first piston and the second piston are positioned inside the combustion chamber and arranged in opposing relationship to each other.

6. The inwardly opposed piston, fixed position common cylinder engine with external induction as claimed in claim 1 wherein:

the first crankshaft is extended from the first crank chamber and is concentrically engaged to the first crankshaft gear;

the second crankshaft is extended from the second crank chamber and is concentrically engaged to the second crankshaft gear;

the first and second timing shafts are each concentrically connected to one of the first and second valve gears, respectively;

the first and second timing bevel gears are concentrically connected to the first and second timing shafts, respectively, and are engaged to the first and second cylinder bevel gears, respectively.

7. An inwardly opposed piston, fixed position common cylinder engine with external induction comprises:

a shared cylinder containing a periphery, a first end, a second end, and a median portion, the shared cylinder further comprising a combustion chamber, at least one valve module opening, at least one ignition point, and a pair of opposing piston openings;

at least one cylinder bevel gear fixed about the periphery and the median portion;

at least one cam wheel fixed to said at least one cylinder bevel gear, said at least one cam wheel rotatable about said shared cylinder;

at least one valve module operably communicating with said shared cylinder and said at least one cam wheel, the at least one valve module comprising at least one timing wheel rotatable communicating with said at least one cam wheel, a rocker, and a push rod operably connecting said at least one cam wheel and said rocker;

a multi-gear chamber for containing a multi-gear assembly, the multi-gear assembly comprising at least one valve gear, and, at least one crankshaft gear, each of said gears interlocking with at least one other of said gears;

a first crankshaft contained within a first crank chamber and rotatably communicating with said first crank gear, and, a second crankshaft contained within a second crank chamber and rotatably communicating with said second crank gear;

at least one pair of pistons contained within said shared cylinder and operably communicating with said first and second crank shafts;

at least one timing bevel gear rotatably communicating with said at least one valve gear, said at least one timing bevel gear also rotatably communicating with said at least one cylinder bevel gear; and at least one timing shaft connecting said at least one valve gear with said at least one timing bevel gear.

8. The inwardly opposed piston, fixed position common cylinder engine with external induction as claimed in claim 7 wherein:

the combustion chamber is a cylindrical space traversing through the shared cylinder;

the at least one valve module openings comprises holes traversing through the shared cylinder into the combustion chamber and is circumferentially positioned about the shared cylinder;

the at least one ignition point is circumferentially positioned about the shared cylinder adjacent to the at least one valve module opening;

the pair of piston openings are positioned on a first end and a second end of the shared cylinder, respectively, leading into the combustion chamber.

9. The inwardly opposed piston, fixed position common cylinder engine with external induction as claimed in claim 7 wherein:

each one of the pair of cylinder bevel gears is concentrically attached to the shared cylinder by means of a corresponding one of a pair of bearings, wherein the each one of the pair of cylinder bevel gears is directly positioned adjacent to the at least one valve module opening;

each one of the pair of cam wheels is concentrically fastened to a corresponding one of the pair of cylinder bevel gears.

10. The inwardly opposed piston, fixed position common cylinder engine with external induction as claimed in claim 7 wherein:

the at least one valve module is fastened to the at least one valve module opening;

the at least one timing wheel is engaged to the at least one cam wheel;

the push rod is attached to the at least one timing wheel;

the push rod is engaged to the rocker.

11. The inwardly opposed piston, fixed position common cylinder engine with external induction as claimed in claim 7 wherein:

the first and second crank chambers are fastened to the shared cylinder, wherein the first crank chamber is fastened to the first cylinder end of the shared cylinder and the second crank chamber is fastened to the second cylinder end of the shared cylinder;

each crankshaft comprises a crank, wherein the first crankshaft comprises a first crank and the second crankshaft comprises a second crank;

the first crank is positioned in the first crank chamber;

the second crank is positioned in the second crank chamber;

the pair of pistons are jointly secured to the cranks of the pair of crankshafts, wherein a first piston is jointly secured to the first crank and a second piston is jointly secured to the second crank; and the first piston and the second piston are positioned inside the combustion chamber and arranged in opposing relationship to each other.

12. The inwardly opposed piston, fixed position common cylinder engine with external induction as claimed in claim 11 wherein:

the first crankshaft extends from the first crank chamber and is concentrically engaged to the first crankshaft gear;

the second crankshaft extends from the second crank chamber and is concentrically engaged to the second crankshaft gear;

the at least one timing bevel gear is concentrically connected to the at least one timing shaft and is engaged to the at least one cylinder bevel gear.

13. An inwardly opposed piston, fixed position common cylinder engine with external induction comprises:

a shared cylinder containing a periphery, a first end, a second end, and a median portion, the shared cylinder further comprising a combustion chamber, at least one valve module opening, at least one ignition point, and a pair of opposing piston openings;

at least one cylinder bevel gear fixed about the periphery and the median portion;

at least one cam wheel fixed to said at least one cylinder bevel gear, said at least one cam wheel rotatable about said shared cylinder;

at least one valve module operably communicating with said shared cylinder and said at least one cam wheel, the at least one valve module comprising at least one timing wheel rotatable communicating with said at least one cam wheel, a rocker, and a push rod operably connecting said at least one cam wheel and said rocker;

a multi-gear chamber for containing a multi-gear assembly, the multi-gear assembly comprising at least one valve gear, and, at least one crankshaft gear, each of said gears interlocking with at least one other of said gears;

a first crankshaft contained within a first crank chamber and rotatably communicating with said first crank gear, and, a second crankshaft contained within a second crank chamber and rotatably communicating with said second crank gear;

at least one pair of pistons contained within said shared cylinder and operably communicating with said first and second crank shafts;

at least one timing bevel gear rotatably communicating with said at least one valve gear, said at least one timing bevel gear also rotatably communicating with said at least one cylinder bevel gear; and at least one timing shaft connecting said at least one valve gear with said at least one timing bevel gear;

wherein the combustion chamber is a cylindrical space traversing through the shared cylinder, the at least one valve module opening comprises holes traversing through the shared cylinder into the combustion chamber and being circumferentially positioned about the shared cylinder, the at least one ignition point is circumferentially positioned about the shared cylinder adjacent to the at least one valve module opening, and each of the pair of piston openings is singularly positioned on either the first end or the second end of the shared cylinder leading into the combustion chamber.

14. The inwardly opposed piston, fixed position common cylinder engine with external induction as claimed in claim 13 further comprising:

a pair of cylinder bevel gears concentrically attached to the shared cylinder by means of a pair of bearings, wherein each of the cylinder bevel gears is directly positioned adjacent to the at least one valve module opening; and a pair of cam wheels being concentrically fastened to the pair of cylinder bevel gears.

15. The inwardly opposed piston, fixed position common cylinder engine with external induction as claimed in claim 13 wherein, the at least one valve module is fastened to the at least one valve module opening;

the at least one timing wheel is engaged to the at least one cam wheel;

the push rod is attached to the at least one timing wheel; and the push rod is engaged to the rocker.

16. The inwardly opposed piston, fixed position common cylinder engine with external induction as claimed in claim 13 comprises:

the pair of crank chambers being fastened to the shared cylinder, wherein a first crank chamber is fastened to a first cylinder end of the shared cylinder and a second crank chamber is fastened to a second cylinder end of the shared cylinder;

each crankshaft of the pair of crankshafts comprises a crank, wherein a first crankshaft comprises a first crank and a second crankshaft comprises a second crank;

the first crank being positioned in the first crank chamber;

the second crank being positioned in the second crank chamber;

the pair of pistons being jointly secured to the cranks of the pair of crankshafts, wherein a first piston is jointly secured to the first crank and a second piston is jointly secured to the second crank;

the first piston and the second piston being positioned inside the combustion chamber and arranged in opposing relationship to each other.

17. The inwardly opposed piston, fixed position common cylinder engine with external induction as claimed in claim 16 comprising:

the at least one crankshaft gears is engaged to the at least one valve gear;

the multi gear assembly is encased by the quad gear chamber;

the first crankshaft is extended from the first crank chamber and is concentrically engaged to the first crankshaft gear;

the second crankshaft is extended from the second crank chamber and is concentrically engaged to the second crankshaft gear, the at least one timing shaft is engaged and extended from the pair of valve gears;

the at least one timing bevel gear is concentrically connected to the at least one timing shaft and is engaged to the at least one cylinder bevel gear.

* * * * *